United States Patent [19]

Matsuzaki et al.

[11] Patent Number: 4,471,264

[45] Date of Patent: Sep. 11, 1984

[54] CATHODE RAY TUBE

[75] Inventors: Osamu Matsuzaki, Mobara; Masakazu Manako, Sakura; Noboru Toyama; Yoshinori Oyamada, both of Mobara, all of Japan

[73] Assignee: Hitachi, Ltd., Tokyo, Japan

[21] Appl. No.: 293,442

[22] Filed: Aug. 14, 1981

[30] Foreign Application Priority Data

Aug. 29, 1980 [JP] Japan ..... 55-118305

[51] Int. Cl.[3] ..... H01J 29/96

[52] U.S. Cl. ..... 315/3; 313/479; 315/47; 315/73

[58] Field of Search ..... 315/3, 46, 47, 73; 313/477 HC, 479, 481

[56] References Cited

U.S. PATENT DOCUMENTS 4,101,803 7/1978 Retsky et al. ..... 315/3

*Primary Examiner*—Eugene R. LaRoche

*Attorney, Agent, or Firm*—Charles E. Pfund

[57] ABSTRACT

An electrical conductor device is connected between an anode voltage supply terminal on the funnel and an electron gun assembly in the neck in parallel with a conductive inner graphite film for electrical connection of the terminal and the assembly. The conductive inner graphite film has a high-resistance portion and a low-resistance portion, and the electrical conductor device has a smaller resistance than that of the high-resistance portion. Upon spot knocking, high voltage is selectively supplied to the electron gun assembly through the electrical conductor device and in operation, through the conductive inner graphite film.

8 Claims, 8 Drawing Figures

CATHODE RAY TUBE

BACKGROUND OF THE INVENTION

This invention relates to cathode ray tubes and more particularly to a cathode ray tube adapted for protection of inner electrodes and external electric circuits such as video circuit and tuner circuit against spark energy generated within the tube and prevention of the television set from erroneous operation and trouble.

In recent years, earnest demand for improved properties of television sets such as increased image brightness has resulted in widespread practice of setting the anode voltage of cathode ray tubes to a high range of 20 to 30 KV. Consequently, the interior of such a cathode ray tube frequently undergoes various forms of electric discharge such as, for example, surface creepage occurring on the bead glass holding a plurality of electrodes fast in position and sparks due to accumulation of foreign matters. Such electric discharge inherently entails release of huge energy. The discharged electric energy does harm to the oxide substance, which is applied as the source for emission of thermo-electrons to the surface of the heater electrode and weak in structure as compared with the other electrodes, as well as to various external electronic circuits such as the video circuits and tuner circuits. Thus, the frequent electric discharge forms the cause for erroneous operation and even failure of the television set.

To overcome such disadvantages, there has been recently introduced a so-called soft-flash tube wherein a portion of the conductive film applied to the inner wall surface of the funnel envelope is made to offer a high resistance enough to hold down the peak current during electric discharge.

FIG. 1 illustrates, in fragmentary sectional form, a typical soft-flash tube as mentioned above. In the figure, an envelope of the tube consists of a panel 1, a funnel 2*a*, and a neck 2*b*. Reference numeral 3 designates a shadow mask disposed inside the panel 1, 4 an inner graphite film of a low resistance deposited on the inner wall surface of the funnel 2*a*, 5 a high-resistance graphite film of $TiO_2$ family deposited on the inner wall surface of the funnel 2*a*, 6 an inner graphite film of a low resistance deposited on the inner wall surface of the neck 2*b*, 7 an anode voltage supply terminal in the form of an anode button buried in the funnel 2*a* and adapted to feed a high voltage from the outside to the inner graphite film 4, 8 an electron gun assembly, 9 a bulb spacer contact having a contact piece thereof held in contact with the inner graphite film 6 to form part of the electron gun assembly 8 and also serving to receive and supply the high voltage, 10 a getter carried by the free end of a getter support spring 11 extending from the electron gun assembly, and 12 an outer electroconductive film deposited on the outer surface of the funnel 2*a*.

In the cathode ray tube constructed as described above, the high anode voltage is supplied from the anode button 7 via the high-resistance graphite film 5 and the bulb spacer contact 9 to the electron gun assembly 8. In this case, since the high-resistance graphite film 5 intervening between the anode button 7 and the bulb spacer contact 9 offers a high resistance of the order of several hundred KΩ, the electric current which flows when a spark occurs between the electrodes of the electron gun assembly 8 and between the electron gun assembly 8 and the inner graphite film 6 of the neck can be lowered to a level of one-several tenth of the level usual with the conventional type. Further, spark current due to discharge current from a capacitor formed by the inner graphite film 4 together with the high-resistance graphite film 5 and the outer conductive film 12 on the funnel 2*a* is similarly lowered.

Incidentally, the cathode ray tube of the aforementioned construction is generally manufactured by a process as illustrated in FIG. 2. Prior to aging under conditions for the tube in operation, the cathode ray tube is subjected to so-called "spot knocking" in which the foregin particles and metal burrs adhering to the electrodes of the electron gun assembly 8 are burnt off or fused by impulse and heat of high-voltage spark and vaporized for removal. This spot knocking is effected by feeding a high voltage from the anode button 7 thereby forcibly setting up sparks between the high-resistance graphite film 5 and the electron gun assembly 8 and between the electrodes of the electron gun assembly 8.

However, in the cathode ray tube which has the high-resistance graphite film 5 on the inner wall surface of the funnel 2*a* for the purpose of lowering spark current in operation as described above, the magnitude of spark current for spot knocking is lowered and consequently the effect of the spot knocking manifested in the removal of foreign particles and metal burrs is notably impaired. Thus, there ensues a disadvantage that the withstand voltage characteristic of the tube is seriously degraded.

SUMMARY OF THE INVENTION

An object of this invention is to provide a cathode ray tube which can assure compatibitity between spark characteristics in operation and spot knocking characteristics, thereby improving withstand voltage characteristics.

To accomplish the above object, according to the invention, an electrical conductor device is connected between an anode voltage supply terminal on the funnel and an electron gun assembly in the neck in parallel with a conductive inner graphite film for electrical connection of the terminal and the assembly. The conductive inner graphite film has a high-resistance portion and a low-resistance portion, and the electrical conductor device has a smaller resistance than that of the high-resistance portion. Upon spot knocking, high voltage is selectively supplied to the electron gun assembly through the electrical conductor device and in operation, through the conductive inner graphite film. The electrical conductor device ensures application of current to the electron gun assembly which is sufficient for spot knocking. While, the conductive inner graphite film holds down peak of discharge current in operation.

DESCRIPTION OF PREFERRED EMBODIMENTS

Figure 1:
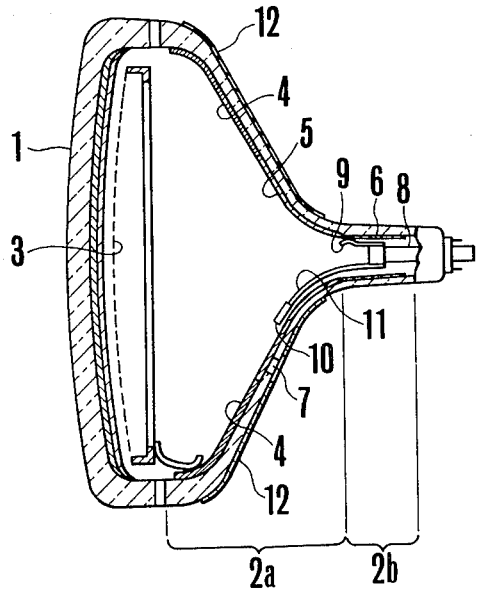
FIG. 1 shows, partly in section, a conventional cathode ray tube.
Figure 2:
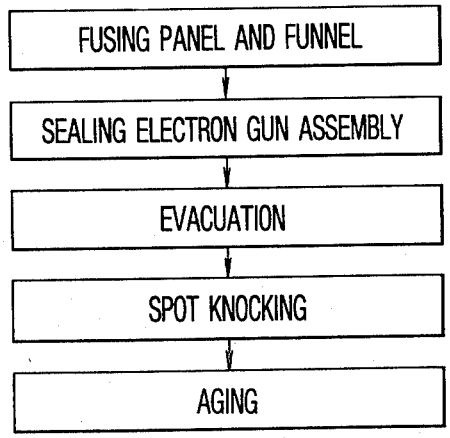
FIG. 2 is a diagram to explain the manufacture process of cathode ray tubes.
Figure 3:
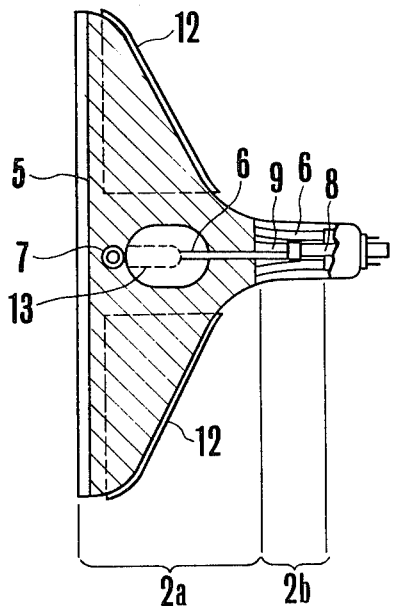
FIG. 3 shows, partly in section, a first embodiment of the invention.
Figure 4:
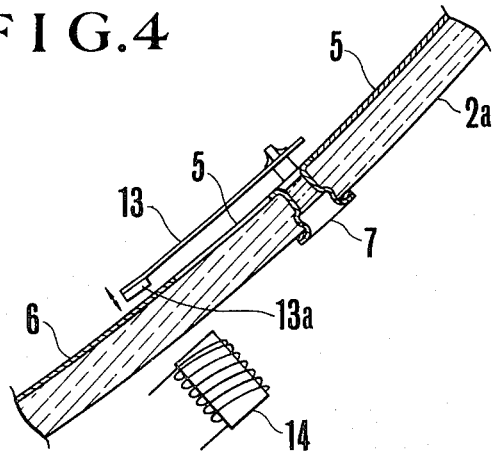
FIG. 4 is a fragmentary section view of the FIG. 3 embodiment.

FIGS. 3 and 4 show a preferred embodiment of the invention, in which the same numerical symbols as those in FIG. 1 denote the same components. Thus, their description is omitted here. With reference to these figures, an inner graphite film strip 6 of low resistance deposited on the inner surface of the neck extends to the inner wall surface of the funnel in the vicinity of the anode button 7. Connected to the anode button 7 is a reed switch 13 for spot knocking which has a switch contact 13*a* actuatable normal to one end of the inner graphite film strip 6. Adjacent to an outer surface of the funnel 2*b* opposed to the switch contact 13*a*, there is disposed an operating magnet 14 which makes the switch contact 13*a* come into contact with or separate from the inner graphite film strip 6.

In the cathode ray tube constructed as described above, the operating magnet 14 is put to work only at the time that the spot knocking is to be started, so that the contact 13*a* of the reed switch 13 is brought into contact with the inner graphite film strip 6 of low resistance in advance and then held in that state while the spot knocking is in process. After the spot knocking is completed, the operating magnet 14 is removed and the contact 13*a* of the reed switch is consequently separated from the inner graphite film strip 6. When the cathode ray tube of this construction is subjected to the spot knocking, the high voltage applied to the anode button 7 is applied through the reed switch 13, the low-resistance inner graphite film strip 6 and the bulb spacer contact 9 to the electron gun assembly 8 without causing any appreciable voltage drop, and the foregin particle and metal burrs adhering to the electrodes can effectively be vaporized and removed. During the operation or actual service of the cathode ray tube, energy of spark is mainly due to charge stored in a capacitor formed between the outer conductive film 12 and the high-resistance graphite film 5. Accordingly, by properly defining areas over which the high-resistance graphite film 5, the low-resistance inner graphite film 6 and the outer conductive film 12 are applied, discharge current from the capacitor coming into the electron gun assembly can be decreased and at the same time current necessary for spot knocking can be assured.

Figure 5:
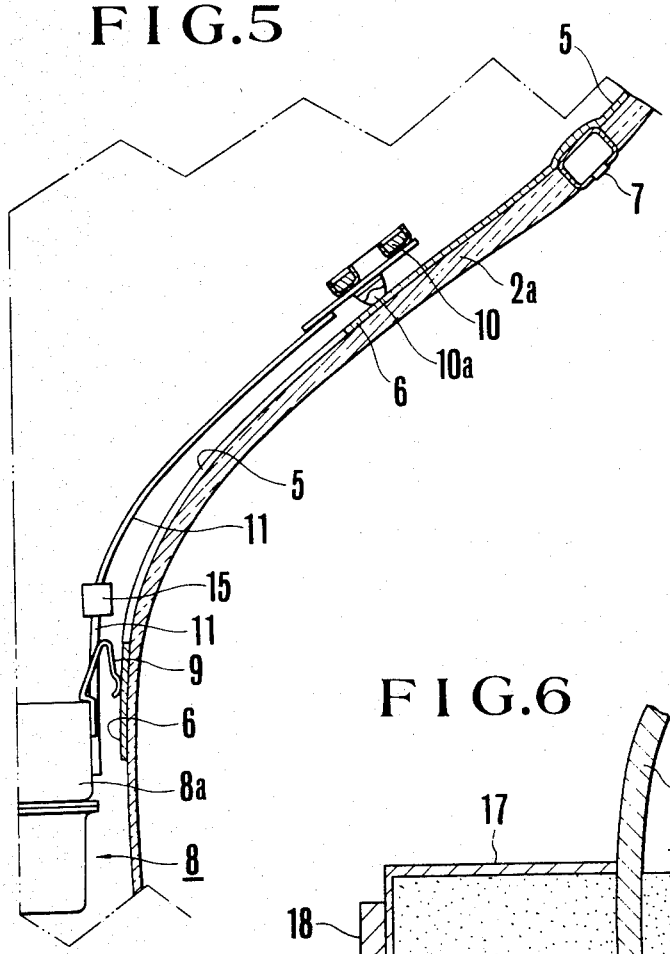
FIG. 5 is a fragmentary section view showing a second embodiment of the invention.

FIG. 5 shows another embodiment of this invention. The same numerical symbols in this figure as those in the previous figures denote the same components. The description of such components is omitted here. As illustrated, a getter member 10 is disposed at the leading end of a conductive getter support spring 11 welded to the shield cup 8*a* of the electron gun assembly 8. This getter member 10 is so disposed that, through the medium of a crossbar 10*a* thereof, it is brought into electrical contact with a low-resistance graphite film 6 electrically connected to the anode button 7. Between halves of the getter support spring 11, there is provided a breaker 15 which functions to keep down the resistance in the discharge current path to a low level and enhance the effect of spot knocking while the spot knocking is in process and shut down the low-resistance circuit after completion of the spot knocking.

Figure 6:
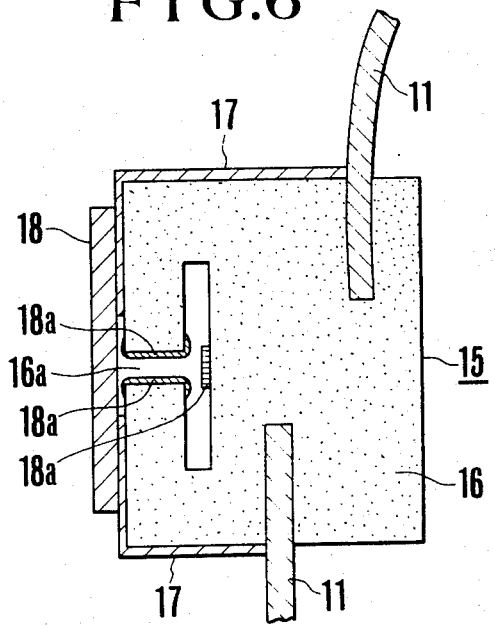
FIG. 6 is a sectional view showing the construction of a breaker used in FIG. 5.

As illustrated in FIG. 6, this breaker 15 has an insulating member 16 of a ceramic material, for example. One half of the getter support spring 11 carrying the getter 10 at the end thereof and the other half of the getter support spring 11 fixed to the shield cup 8*a* are fixedly secured to the insulating member 16. Connected to respective halves are conductor films 17 deposited on the surface of the insulating member 16, with the other ends of the conductor films 17 connected electrically with each other by means of a volatile conductor plate 18.

In this case, the conductor films 17 oppose through a slit-shaped recess 16*a* formed in the insulating member 16, and the volatile conductor plate 18 bridges the opposed ends of the conductor films 17 and occludes the recess 16*a*.

In the cathode ray tube constructed as described above, a low-resistance electric discharge path is formed through anode button 7, low-resistance graphite film 6, the getter crossbar 10*a*, one half of the getter support spring 11, conductor film 17, volatile conductor plate 18, conductor film 17, the other half of the getter support spring 11 and shield cup 8*a* of the electron gun assembly 8 during the spot knocking step. After completion of the spot knocking, the volatile conductor plate 18 is vaporized by indirect heating such as by means of high-frequency induction heating from outside the cathode ray tube to separate electrically the two halves of the getter support spring 11 from each other through the insulating member 16. Consequently, the path for the discharge current in operation now excludes the getter support spring 11 and it is, instead, established through anode button 7, high-resistance graphite film 5, inner graphite film 6, bulb spacer contact 9, shield cup 8*a* and electron gun assembly 8. Thus, the discharge circuit now has a high resistance so that the finished cathode ray tube, as a soft-flash tube, can keep down the discharge current to a low level while the tube is in actual use. Films 18*a* found inside the recess 16*a* are automatically deposited when the bridging volatile conductor plate 18 is evaporated and no use, therefore, is found for the vapor deposited films 18*a*.

Figure 7:
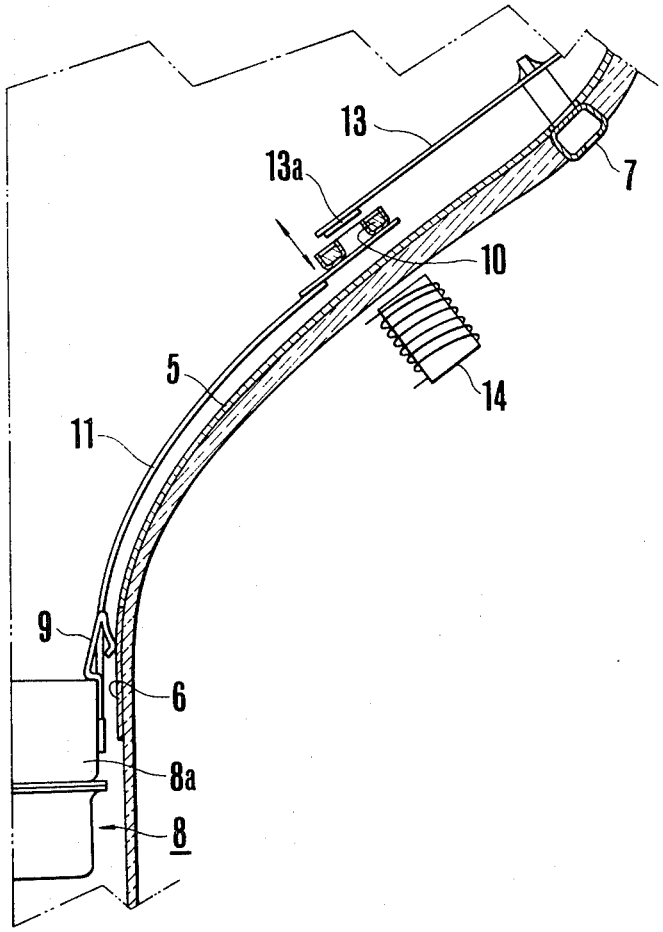
FIG. 7 is a fragmentary section view showing a third embodiment of the invention.

FIG. 7 shows yet another embodiment of the invention in which a getter member 10 provided at the fore end of a getter support spring 11 is spaced apart from the inner graphite film 6. Disposed above the getter member 10 is a contact 13*a* of a reed switch 13 connected to the anode button 7. An externally disposed operating magnet 14 opposes the getter member 10 on the getter support spring 11 fixed to the electron gun assembly for switching on or off the contact 13*a* with respect to the getter member 10 in directions designated by arrows.

With this construction, when spot knocking, the operating magnet 14 is energized to bring the contact 13*a* into contact with the getter member 10. After the spot knocking is completed, the operating magnet 14 is removed and the reed switch 13 is therefore turned off. During the operation of the cathode ray tube, soft flash effect thanks to the inner graphite film fully fulfills itself.

Figure 8:
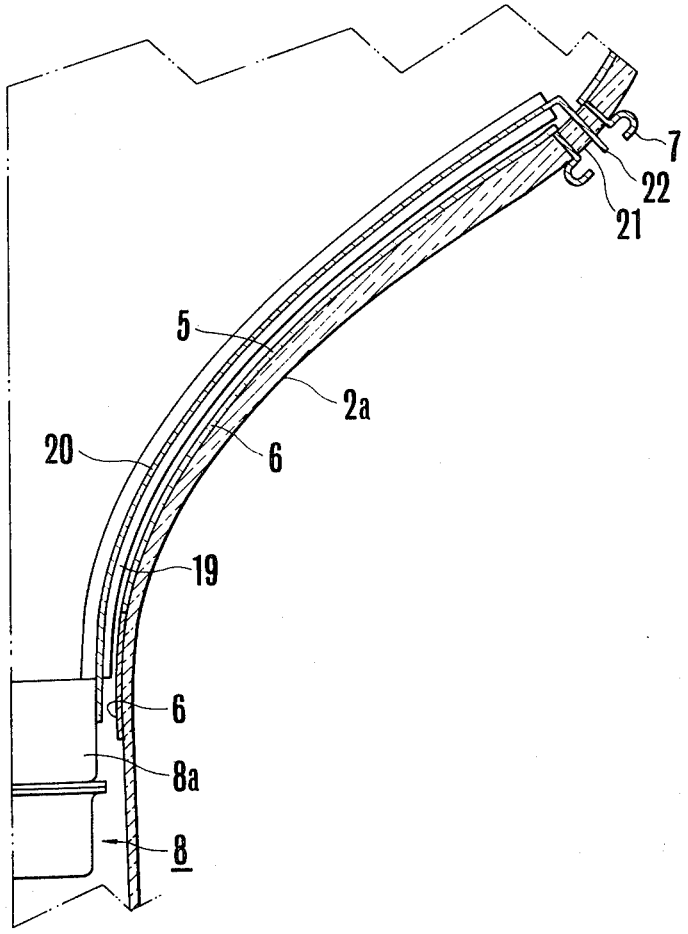
FIG. 8 is a similar view showing a fourth embodiment of the invention.

FIG. 8 shows yet another embodiment of this invention. The same numerical symbols in this figure as those in the previous figures denote the same components. Thus, the description of these components is omitted here. As illustrated in FIG. 8, a conductive lead 20 having an isolation cover, for example, in the form of a porcelain insulator 19 is connected to the leading end of the shield cup 8a and the other end of the conductive lead 20 airtightly pierces through a glass insulator 21 packed inside the anode button 7 and projects from the glass insulator to constitute an electrode terminal 22 exclusively used for spot knocking. In this case, the anode button 7 and the inner graphite film 5 are electrically connected to each other and the electrode terminal 22 and the anode button 7 are electrically isolated by means of the glass insulator 21.

In the cathode ray tube as described above, by directly applying a voltage via the electric terminal 22 to the electron gun assembly 8, the spot knocking is effected sufficiently for the electrodes, thus enhancing the withstand voltage property. When the cathode ray tube is put to actual use, the anode button 7 is utilized to make full use of the soft flash effect brought about by the inner graphite film. In the cathode ray tube of this construction, the portion of the electrode terminal 22 jutting out of the glass insulator may be cut off and discarded or may be shielded with some suitable insulating substance after spot knocking.

As described above, this invention offers the cathode ray tube which enjoys high withstand voltage characteristics, warrants high efficiency in production and, as a soft flash tube, effectively keeps down the discharge current to a low level.

What is claimed is:

1. In a cathode ray tube comprising anode voltage supply terminal means arranged at a funnel of an envelope comprised of a panel, the funnel and a neck, a conductive inner graphite film deposited on the inner surface of the envelope over the funnel and neck, said graphite film having a high-resistance portion connected to the anode voltage supply terminal means and a low-resistance portion formed at the neck, and an electron gun assembly arranged in the neck and having a bulb spacer contact in contact with the low-resistance portion of said graphite film, said cathode ray tube comprising electrical conductor means arranged between said anode voltage supply terminal means and electron gun assembly and having a resistance which is smaller than that of the high-resistance portion, and means for selectively applying high voltage from said anode voltage supply terminal means to said electron gun assembly by way of said electrical conductor means so that an amount of current sufficient for spot knocking is applied to said electron gun assembly.

2. In a cathode ray tube having anode voltage supply terminal means arranged at a funnel of an envelope comprised of a panel, the funnel and a neck, a conductive inner graphite film deposited on the inner surface of the envelope over the funnel and neck, said graphite film having a high-resistance portion connected to the anode voltage supply terminal means and a low-resistance portion formed at the neck, and an electron gun assembly arranged in the neck and having a bulb spacer contact in contact with the low-resistance portion of said graphite film, said cathode ray tube comprising a read switch connected at one end to said anode voltage supply terminal means, and a low-resistance graphite film strip connected to said low-resistance portion, said low-resistance graphite film strip having a resistance which is smaller than that of the high-restance portion, said film strip opposing a switch contact at the other end of the reed switch, and said reed switch is driven externally to bring the switch contact into contact with the low-resistance graphite film strip so as to selectively apply high voltage from said anode voltage supply terminal means to said electron gun assembly by way of said low-resistance graphite film strip.

3. In a cathode ray tube having anode voltage supply terminal means arranged at a funnel of an envelope comprised of a panel, the funnel and a neck, a conductive inner graphite film deposited on the inner surface of the envelope over the funnel and neck, said graphite film having a high-resistance portion and a low-resistance portion, and an electron gun assembly arranged in the neck, said cathode ray tube comprising a low-resistance graphite film connected to said anode voltage supply terminal means, said low-resistance graphite film having a resistance which is smaller than that of the high-resistance portion, and a getter support spring having one half electrically connected to said low-resistance graphite film and an other half fixedly secured to said electron gun assembly, and a breaker interposed between the halves of the getter support spring so as to apply high voltage from said anode voltage supply terminal means to said electron gun assembly by way of said low-resistance graphite film until said breaker is broken by external heat.

4. In a cathode ray tube having anode voltage supply terminal means arranged at a funnel of an envelope comprised of a panel, the funnel and a neck, a conductive inner graphite film deposited on the inner surface of the envelope over the funnel and neck, said graphite film having a high-resistance portion and a low-resistance portion, and an electron gun assembly arranged in the neck, said cathode ray tube comprising electrical conductor means arranged between said anode voltage supply terminal means and electron gun assembly and having a resistance which is smaller than that of the high-resistance portion, and means for selectively applying high voltage from said anode voltage supply terminal menas to said electron gun assembly by way of said electrical conductor means, wherein said electrical conductor means comprises a reed switch connected at one end to said anode voltage supply terminal means, and a getter support spring having one end opposing a switch contact at the other end of the reed switch and the other end fixedly secured to said electron gun assembly, and wherein said reed switch is driven externally to act as said selectively applying means so as to bring the switch contact into contact with the one end of the getter support spring.

5. In a cathode ray tube having anode voltage supply terminal means arranged at a funnel of an envelope comprised of a panel, the funnel and a neck, a conductive inner graphite film deposited on the inner surface of the envelope over the funnel and neck, said graphite film having a high-resistance portion and a low-resistance portion, and an electron gun assembly arranged in the neck, said cathode ray tube comprising electrical conductor means arranged between said anode voltage supply terminal means and electron gun assembly and having a resistance which is smaller than that of the high-resistance portion, and means for selectively applying high voltage from said anode voltage supply terminal means to said electron gun assembly by way of said electrical conductor means, wherein said electrical conductor means comprises a conductor lead with insulation cover having one end in the proximity of said anode voltage supply terminal means and the other end fixedly secured to said electron gun assembly, and wherein said one end of the conductor lead is electrically insulated from said anode voltage supply terminal means and projects exteriorly of the envelope to act as said selectively applying means.

6. A cathode ray tube as recited in claim 3 wherein said breaker comprises an insulating member fixed to said halves and formed with a slip-shaped recess, conductor films deposited on the insulating member and respectively connected to each of said halves, said conductor films opposing to each other through the recess, and a volatile conductor plate bridging the conductor films above said recess.

7. A cathode ray tube as recited in claim 3 wherein the one end of said getter support spring is in electrical contact with said low-resistance graphite film by way of a crossbar.

8. A cathode ray tube as recited in claim 4 wherein said switch contact makes contact to the one end of said getter support spring by way of a getter member.

* * * * *